US007981408B2

(12) United States Patent
Schroeder et al.

(10) Patent No.: US 7,981,408 B2
(45) Date of Patent: Jul. 19, 2011

(54) METHOD OF PRESERVING FOOD USING ANTIMICROBIAL PACKAGING

(75) Inventors: Joseph D. Schroeder, Dedham, MA (US); J. Chad Scales, Darien, CT (US)

(73) Assignee: Boston Brands, Inc., Boston, MA (US)

( * ) Notice: Subject to any disclaimer, the term of this patent is extended or adjusted under 35 U.S.C. 154(b) by 1277 days.

(21) Appl. No.: 11/199,064

(22) Filed: Aug. 8, 2005

(65) Prior Publication Data

US 2005/0271780 A1 Dec. 8, 2005

Related U.S. Application Data

(62) Division of application No. 09/834,842, filed on Apr. 13, 2001, now abandoned.

(60) Provisional application No. 60/196,982, filed on Apr. 13, 2000.

(51) Int. Cl.
*A61K 31/00* (2006.01)

(52) U.S. Cl. ..... 424/78.09; 424/405; 424/414; 424/415

(58) Field of Classification Search ..... None
See application file for complete search history.

(56) References Cited

U.S. PATENT DOCUMENTS 3,580,478 A * 5/1971 Bemiss ..... 229/123.2
3,857,934 A 12/1974 Bernstein et al.
4,128,429 A 12/1978 Wyant et al.
4,427,796 A 1/1984 Nudel et al.
4,532,128 A 7/1985 Sheldon et al.
4,708,870 A 11/1987 Pardini
4,847,088 A 7/1989 Blank
4,877,617 A 10/1989 Namikoshi et al.
4,990,547 A 2/1991 Stovicek
4,994,199 A 2/1991 Scardera et al.
5,024,875 A 6/1991 Hill et al.
5,093,078 A 3/1992 Hollis et al.
5,096,488 A 3/1992 Stovicek
5,120,530 A 6/1992 Ferro et al.
5,169,561 A 12/1992 Gentle et al.
5,296,238 A 3/1994 Sugiura et al.
5,302,192 A 4/1994 McLearie et al.
5,336,305 A 8/1994 Staats
5,358,688 A 10/1994 Robertson
5,399,343 A 3/1995 Smith, Jr.
5,441,717 A 8/1995 Ohsumi et al.
5,554,373 A 9/1996 Seabrook et al.
5,573,797 A 11/1996 Wilhoit
5,573,800 A 11/1996 Wilhoit
5,573,801 A 11/1996 Wilhoit
5,639,466 A 6/1997 Ford et al.
5,681,523 A 10/1997 Cobler et al.
5,698,229 A 12/1997 Ohsumi et al.
5,759,844 A 6/1998 Hiraki et al.
5,774,889 A 7/1998 Gochanour
5,785,963 A 7/1998 Tseng
5,788,687 A 8/1998 Batich et al.
5,827,524 A 10/1998 Hagiwara et al.
5,869,133 A 2/1999 Clayton et al.
5,906,825 A 5/1999 Seabrook, Jr. et al.
5,929,133 A 7/1999 Watanabe et al.
5,951,799 A 9/1999 Williamson et al.
5,955,486 A 9/1999 Mattox
5,962,137 A 10/1999 Ochiai et al.
5,972,519 A 10/1999 Niessner et al.
6,126,931 A * 10/2000 Sawan et al. ..... 424/78.09
6,194,530 B1 * 2/2001 Klesse et al. ..... 526/312
6,890,969 B2 5/2005 Rabasco et al.
2003/0147925 A1 * 8/2003 Sawan et al. ..... 424/400

OTHER PUBLICATIONS

S. Imazato et al. Incorporation of Antibacterial Monomer MDPB into Dentin Primer; J. Dent. Res. 76(3): 768-772, Mar. 1997.
El-Refaie Kenawy et al. Biologically active polymers: synthesis and antimicrobial activity of modified glycidyl methacrylate polymers having a quaternary ammonium and phosphonium groups; Journal of Controlled Release 50: 145-152, (1998).
P. Suppakul et al. Active Packaging Technologies with an Emphasis on Antimicrobial Packaging and its Applications; Journal of Food Science—vol. 68, Nr. 2, (2003).

* cited by examiner

*Primary Examiner* — Anand Desai
*Assistant Examiner* — Melissa S Mercier
(74) *Attorney, Agent, or Firm* — St. Onge Steward Johnston & Reens LLC

(57) ABSTRACT

The present invention relates to an anti-microbial packaging polymer and its method of use, and more particularly to a contact anti-microbial such as quaternary ammonium and phosphonium salts covalently bound to a polymeric material that may be suitable in a variety of applications such as film and container packaging of foodstuffs, cosmetics, medical equipment and devices, environmental, hygienic and sanitary applications, as well as other consumer and commercial use. This anti-microbial polymer has the benefit of being bactericidal, fungicidal, and/or viricidal. For example, this anti-microbial feature may result in additional shelf life of the foodstuff contained in the anti-microbial packaging polymer of the present invention.

21 Claims, 10 Drawing Sheets

GENERIC POLYMER STRUCTURE

METHOD OF PRESERVING FOOD USING ANTIMICROBIAL PACKAGING

CROSS-REFERENCE TO RELATED APPLICATIONS

The is a divisional patent application of co-pending U.S. patent application Ser. No. 09/834,842 for an "Anti-Microbial Packaging Polymer And Its Method Of Use," filed Apr. 13, 2001now abandoned, which claims the benefit of U.S. Provisional Application for No. 60/196,982 for an "Anti-Microbial Packaging Polymer And Its Method Of Use," filed Apr. 13, 2000.

FIELD OF THE INVENTION

The present invention relates to covalently bonding anti-microbial agents to the surface of a selected polymer and its method of use as an anti-microbial agent to reduce surface bacterial, fungus, and/or virus count of the material it contacts. The invention can be applied to a variety of applications such as film and container packaging of foodstuffs, cosmetics, medical equipment and devices, environmental, hygienic and sanitary applications, as well as other consumer and commercial use.

BACKGROUND OF THE INVENTION

The invention relates to a contact anti-microbial covalently bound to a polymeric material that may be suitable in a variety of applications such as film and container packaging of foodstuffs, cosmetics, medical equipment and devices, environmental, hygienic and sanitary applications, as well as other consumer and commercial use. In one aspect of the invention and not as a limitation, the invention provides anti-microbial compositions covalently linked to packaging and processing films for foodstuff and methods for inhibiting or preventing growth of microbes such as bacteria, molds and yeast on food surfaces.

In this aspect of the invention, an anti-microbial agent is covalently bound to polymeric films used to package and wrap food for the purpose of reducing surface bacterial, fungus, and/or virus count and/or increasing the shelf life of the enveloped food article.

Prior art of interest includes U.S. Pat. No. 4,532,128 (herein incorporated by reference), which relates to polymeric quaternary ammonium compounds having recurring vinylbenzyl ammonium units. The quaternary ammonium units preferably have 2 alkyl substituents of 1 to 4 carbons and 1 alkyl substituent of 4 to 12 carbons. U.S. Pat. No. 4,532,128 specifically relates to non-film materials that have antimicrobial properties and are particularly useful for preserving ophthalmic solutions.

The present invention preferably relates to film compositions capable of killing microbes and therefore useful for food preservation. "Food preservation", as that term is used herein, includes methods, which guard against food poisoning as well as methods, which delay or prevent food spoilage due to microbes. Food preservation keeps food safe for consumption and inhibits or prevents nutrient deterioration or organoleptic changes causing food to become less palatable.

"Food spoilage", as that term is used herein, includes any alteration in the condition of food which makes it less palatable including changes in taste, smell, texture, or appearance. Spoiled food may or may not be toxic.

"Food poisoning", as that term is used herein, refers to mammalian diseases caused by ingestion of food contaminated by pathogenic viruses, molds, or bacteria and/or their toxins. Pathogen-contaminated food does not necessarily show any organoleptic sign of spoilage. Bacterial food poisoning may be caused by either infection of the host by the bacterial organism or by action of the toxin produced by the bacteria either in the food or the host. (See U.S. Pat. No. 5,573,801, incorporated herein by reference). Initial attempts to prevent food spoilage and food poisoning were trial and error. The use of drying, salting, and smoking of food found favor in early ages. Technological advances later showed that chemical agents such as nitrites/nitrates, sulfites, acetic acid (pickling), and antibiotics (natamycin/nisin) could be beneficially applied to foodstuffs. Polymeric films for food packaging have seen increasing use as the importance of retail supermarkets and home use of refrigerators and microwaves has risen. Polymeric films are used because of their convenience in applications of storage and cooking. The advantageous properties are dinginess, air permeability, anti-fogging, and transparency. There are examples of polymeric films which incorporate metallic (See U.S. Pat. Nos. 5,929,133; 6,126,931 and 5,827,524, incorporated herein by reference) and organic (See U.S. Pat. Nos. 5,906,825; 5,759,844; 5,639,466; 5,573,801; 5,573,800; and 5,573,797, incorporated herein by reference) anti-microbials in a non-covalent fashion for use with foodstuffs. There are several disadvantages to these prior art approaches. For example, because the anti-microbial is not covalently bound, it may be leached from the polymeric film, thus the anti-microbial effect decreases with time. Another disadvantage is that some types of anti-microbials are toxic to mammalian species as well as bacteria and would be inappropriate for food applications where the agent could migrate from the package to the foodstuff. Yet a further disadvantage is that an anti-microbial which leaches from the polymeric film may alter the taste and/or appearance of the foodstuff contained within. In the case of films used in cooking, the process of heating may accelerate the migration of the anti-microbial from the film to the foodstuff such that higher levels than acceptable are found on the foodstuff. Thus, the prior art is deficient in affording a contact anti-microbial covalently bound to a polymer which inhibits the growth of microbes while reducing the possibility of leaching or migration of the anti-microbial from the polymer in a form that may be suitable for a variety of applications such as film and container packaging of foodstuffs, cosmetics, medical equipment and devices, environmental, hygienic and sanitary applications, as well as other consumer and commercial use.

SUMMARY OF THE INVENTION

It is the object of the present invention to provide an anti-microbial film compositions characterized as having antimicrobial side chains covalently bound to a polymer. These compositions and stereoisomeric forms thereof, include compounds of formula 1.

(I)

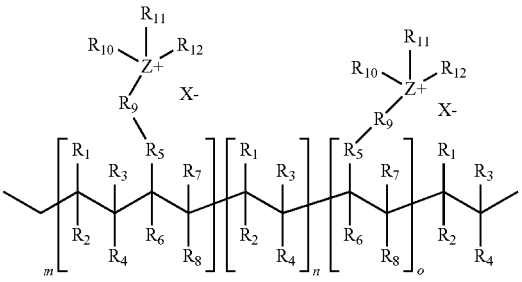

Preferably, R1-12 are functional groups selected from the group consisting of alkyl, lower alkyl, haloalkyl, alkenyl, alkynyl, bridged cycloalkyl, cycloalkyl, heterocyclic ring, heterocyclic group, heterocyclic compounds, aryl, cycloalkenyl, alkylaryl, arylalkyl, cycloalkylalkyl, heterocyclicalkyl, arylheterocyclic ring, alkoxy, aryloxy, arylalkoxy, alkoxyaryl, alkoxyalkyl, alkoxyhaloalkyl, cycloalkoxy, cycloalkylthio, haloalkoxy, hydroxy, oxo, hydroxyalkyl, amino, nitrate, nitro, nitro, cyano, halogen, halo, alkylamino, arylamino, dialkylamino, diarylamino, alkylarylamino, aminoalkyl, aminoaryl, thio, sulfinyl, methanthial, thial, sulfonyl, sulfonic ester, sulfonamido, alkylsulfonamido, arylsulfonamido, alkylthio, arylthio, alkylsulfinyl, alkylsulfonyl, arylsulfinyl, arylsulfonyl, amidyl, ester, carbamoyl, carboxyl, carbonyl, alkylcarbonyl, arylcarbonyl, carboxylic ester, alkylcarboxylic acid, alkylcarboxyl, alkylcarboxylic ester, arylcarboxylic acid, arylcarboxylic ester, arylcarboxyl, carboxamido, alkylcarboxamido, arylcarboxamido, urea, and phosphoryl, and silyl.

Preferably, $R_9$ and $R_{10}$ when taken together are selected from the group consisting of heterocyclic ring, cycloalkyl group, and bridged cycloalkyl group.

Preferably, $R_{10}$ and $R_{11}$ when taken together are selected from the group consisting of heterocyclic ring, cycloalkyl group, and bridged cycloalkyl group.

Preferably, Z is selected from the group consisting of nitrogen and phosphorous.

Preferably, X is selected form the group consisting of a non-leaching counterion and halogen.

Preferably, m, n, o can be the same or different integer within the range from 0-1000.

It is the object of the present invention to provide antimicrobial film compositions wherein the antimicrobial side chain is selected from the group consisting of quaternary ammonium salts, pyridinum salts, and phosphonium salts.

It is the object of the present invention to provide antimicrobial film compositions wherein said antimicrobial film combats the growth of microorganisms selected from the group consisting of bacterium, fungus, molds, yeast, and virus.

It is the object of the present invention to provide antimicrobial film compositions wherein X is an anion of the quaternary salts or comprises the anion of any physiologically acceptable acid.

It is the object of the present invention to provide a packaging composition comprising an antimicrobial packaging polymer characterized by having an antimicrobial agent covalently bound thereto wherein said antimicrobial agent is selected from the group of salts consisting of quaternary ammonium, pyridinium, and phosphonium.

It is the object of the present invention to provide a packaging composition comprising an antimicrobial packaging polymer characterized by having an antimicrobial agent covalently bound thereto wherein the antimicrobial agent is selected from the group of salts consisting of quaternary ammonium, pyridinium, and phosphonium.

It is the object of the present invention to provide a composition for combating the growth of a microorganism selected from the group consisting of bacterium, fungus, and virus comprising a antimicrobial agent covalently bound to a polymer such that the antimicrobial agent and the polymer have the general formula I.

It is the object of the present invention to provide compositions for combating the growth of a microorganism selected from the group consisting of bacterium, fungus, molds, yeast, and virus comprising a antimicrobial agent covalently bound to a polymer such that said antimicrobial agent and said polymer have the general formula I. These compositions comprise X, which is an anion of the quaternary salts and may comprise the anion of any physiologically acceptable acid.

It is the object of the present invention to provide film compositions for combating the growth of a microorganism selected from the group consisting of bacterium, fungus, molds, yeast, and virus. These films are selected from the group consisting of Poly (Dimethyloctyl [(4-vinylphenyl)] methylammonium chloride) and stereochemically isomeric forms thereof.

It is the object of the present invention to provide film composition for combating the growth of a microorganism selected from the group consisting of bacterium, fungus, molds, yeast, and virus. These films are selected from the group consisting of Poly (Dimethyldodecyl[4-vinylphenyl] methylammonium chloride and stereochemically isomeric forms thereof.

It is the object of the present invention to provide film compositions for combating the growth of a microorganism selected from the group consisting of bacterium, fungus, molds, yeast, and virus. These films are selected from the group consisting of Poly (Dimethyltetradecyl[4-vinylphenyl] methylammonium chloride and stereochemically isomeric forms thereof.

It is the object of the present invention to provide film compositions for combating the growth of a microorganism selected from the group consisting of bacterium, fungus, molds, yeast, and virus. These films are selected from the group consisting of Poly (Trioctyl[4-vinylphenyl]methylphosphonium chloride and stereochemically isomeric forms thereof.

It is the object of the present invention to provide a process of packaging objects by providing antimicrobial packaging films, and stereochemical isomeric equivalents thereof, characterized having antimicrobial side chains covalently bound to a polymer. Preferably these polymers are made from monomer units containing reactive groups for forming covalent bounds to substituents in a molecule containing or capable of being transformed into an ammonium or phosphonium salt. The process is suited for packaging a variety of objects including foodstuffs, cosmetic items, medical equipment, medical devices, environmental equipment, environmental devices, sanitary equipment, sanitary devices, and consumer goods. The process provides a packaging film having antimicrobial side chains consisting of quaternary ammonium salts, pyridinium salts, and phosphonium salts, and combinations thereof. These side chains are preferably non-leaching. Such a process is suitable for a variety of applications including film packaging of foodstuff, container packaging of foodstuffs, cosmetics, medical equipment, medical devices, environmental applications, hygienic applications, and sanitation devices, as well as other consumer and commercial uses. These films are preferably used to package and wrap food for the purpose of reducing surface bacterial, fungus, and/or virus count and/or increasing the shelf life of the enveloped food article.

It is the object of the present invention to provide a method of killing microorganisms by providing a substrate having disposed thereon a contact-killing, non leaching antimicrobial coating, said coating comprising an organic polymer matrix having bound or complexed thereto a surface-accessible antimicrobial material such that the antimicrobial coating does not release biocide amounts of elutables into the surrounding environment. Preferably the surface accessible antimicrobial material is made from straight chain polymers. This method includes the step of facilitating contact between the coating and the microorganism to permit direct transfer of the antimicrobial material to the microorganism in an amount sufficient to kill the microorganism. Preferably, the antimicrobial material is selected from benzalkonium halide compounds, quaternary ammonium salts, pyridinum salts, phosphonium salts, and combinations thereof. The substrate is preferably a synthetic polymer however may also include metal, wood, natural and synthetic fibers, cloth, paper, rubbers, and glass. Preferably, suitable organic polymer matrix may include plastic resins selected from the group consisting of polyamide, polyethylene, polyvinylidene chloride, polyvinyl chloride, polyvinylidene, polypropylene, polyethylene terephthalate, polyethylene terephthalte (glycol modified), and polycarbonate. Preferably the organic polymer matrix is a resin comprising a linear, straight chain polymer. Preferably the invention kills microorganisms including bacterium, fungus, molds, yeast, and virus.

It is the object of the present invention to provide compositions and methods of killing microbes on various substrates including medical devices, prosthetics, implants, and medical equipment. For example a catheter, or stent may be a suitable substrate for applying films of the present invention.

DETAILED DESCRIPTION OF THE DRAWINGS

Of the diverse categories of anti-microbial agents and compositions, quaternary ammonium, pyridinium, and phosphonium compounds (quaternary salts) represent one of the largest of the classes of agents in use. At low concentrations, quaternary salts are bacteriostatic, fungistatic, algistatic, sporatatic and tuberculostatic. At medium concentrations they are bactericidal, fungicidal, algicidal and viricidal against lipophilic viruses. (See U.S. Pat. No. 4,847,088, incorporated herein by reference).

The term "microorganism" or "microbe" as used herein includes bacteria, blue-green algae, fungi, yeast, mycoplasmids, protozoa and algae.

The term "biocidal" or "antimicrobial" as used herein means bactericidal or bacteriostatic, fungistatic, algistatic, sporatatic, tuberculostatic, bactericidal, fungicidal, algicidal and viricidal. The term "bactericidal" as used herein means the killing of microorganisms. The term "bacteriostatic" as used herein means inhibiting the growth of microorganisms, which can be reversible under certain conditions.

As used herein, the terms "non-leachable" or "substantially non-leachable" means that none or very minute amounts (e.g., below a certain threshold) of the organic and/or biocidal material dissolves into a liquid environment. Preferably, this threshold is no higher than 1 part per million (ppm), and more preferably is lower than 100 parts per billion (ppb).

Figure 1:
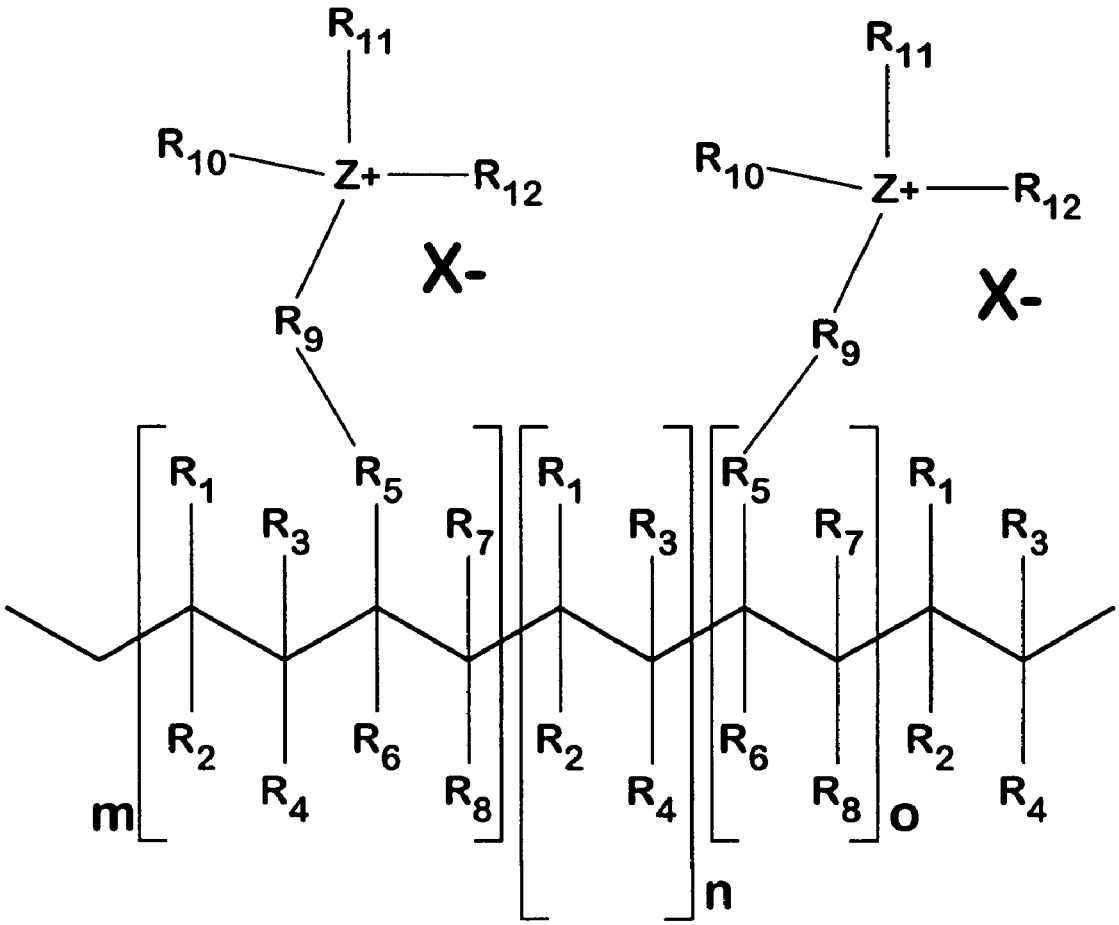
FIG. 1 shows the generic polymer structure of the present invention.

FIG. 1 shows the generic chemical structure of the antimicrobial polymer of the present invention.

$R_{1-12}$ are defined as any combination of the same or different groups listed below. Any individual $R_n$ (n=1-12) can be made up of one or more of the following groups to achieve a full valence throughout. Any individual $R_n$ (n=1-12) may also be covalently bound to a neighboring polymer so as to form cross-links between two polymer main chains. $R_9$ and $R_{10}$ when taken together are a heterocyclic ring, a cycloalkyl group or a bridged cycloalkyl group, as defined herein. $R_{10}$ and $R_{11}$ when taken together are a heterocyclic ring, a cycloalkyl group or a bridged cycloalkyl group, as defined herein.

Z refers to nitrogen or phosphorous.

m, n, o can be the same or different and range from 0-1000.

X— refers to a non-leaching counterion. Exemplary counterions include carbonate, sulfonate, bicarbonate, bisulfonate, mesylate, acetate, and halogen (most preferably a halogen) as defined herein.

"Alkyl" refers to a lower alkyl group, a haloalkyl group, a hydroxyalkyl group, an alkenyl group, an alkynyl group, a bridged cycloalkyl group, a cycloalkyl group or a heterocyclic ring, as defined herein.

"Lower alkyl" refers to branched or straight chain acyclic alkyl group comprising one to about eighteen carbon atoms. Exemplary alkyl groups include methyl, ethyl, n-propyl, isopropyl, n-butyl, isobutyl, sec-butyl, pentyl, neopentyl, isoamyl, hexyl, octyl, decyl, octadecyl and the like.

"Haloalkyl" refers to an alkyl group, an alkenyl group, an alkynyl group, a bridged cycloalkyl group, a cycloalkyl group or a heterocyclic ring, as defined herein, to which is appended one or more halogens, as defined herein. Exemplary haloalkyl groups include trifluoromethyl, chloromethyl, 2-bromobutyl, and the like.

"Alkenyl" refers to a branched or straight chain $C_2$-$C_{18}$ hydrocarbon which can comprise one or more carbon-carbon double bonds. Exemplary alkenyl groups include propylenyl, buten-1-yl, isobutenyl, penten-1-yl, 2,2-methylbuten-1-yl, 3-methylbuten-1-yl, hexan-1-yl, hexan-2-yl, hexan-3-yl octen-1-yl, decen-1-yl, octadecen-1-yl and the like.

"Alkynyl" refers to an unsaturated acyclic $C_2$-$C_{18}$ hydrocarbon which can comprise one or more carbon-carbon triple bonds. Exemplary alkynyl groups include ethynyl, propynyl, butyn-1-yl, butyn-2-yl, pentyl-1-yl, pentyl-2-yl, 3-methylbutyn-1-yl, hexyn-1-yl, hexyn-2-yl, hexyn-3-yl, decyn-1-yl, octadecyn-1-yl and the like, and the like.

"Bridged cycloalkyl" refers to two or more cycloalkyl groups, heterocyclic groups, or a combination thereof fused via adjacent or non-adjacent atoms. Bridged cycloalkyl groups can be unsubstituted or substituted with one, two or three substituents independently selected from alkyl, alkoxy, amino, alkylamino, dialkylamino, hydroxy, halo, carboxyl, alkylcarboxylic acid, aryl, amidyl, ester, alkylcarboxylic ester, carboxamido, alkylcarboxamido, oxo and nitro. Exemplary bridged cycloalkyl groups include adamantyl, decahydronapthyl, quinuclidyl, 2,6-dioxabicyclo[3,3,0]octane, 7-oxabycyclo[2,2,1]heptyl, 8-azabicyclo[3,2,1]oct-2-enyl and the like.

"Cycloalkyl" refers to a saturated or unsaturated cyclic hydrocarbon comprising from about 3 to about 10 carbon atoms. Cycloalkyl groups can be unsubstituted or substituted with one, two or three substituents independently selected from alkyl, alkoxy, amino, alkylamino, dialkylamino, arylamino, diarylamino, alkylarylamino, aryl, amidyl, ester, hydroxy, halo, carboxyl, alkylcarboxylic acid, alkylcarboxylic ester, carboxamido, alkylcarboxamido, oxo and nitro. Exemplary cycloalkyl groups include cyclopropyl, cyclobutyl, cyclopentyl, cyclohexyl, cyclohexenyl, cyclohepta, 1,3-dienyl, and the like.

"Heterocyclic ring or group" refers to a saturated or unsaturated cyclic hydrocarbon group having about 2 to about 10 carbon atoms where 1 to about 4 carbon atoms are replaced by one or more nitrogen, oxygen and/or sulfur atoms. Sulfur maybe in the thio, sulfinyl or sulfonyl oxidation state. The heterocyclic ring or group can be fused to an aromatic hydrocarbon group. Heterocyclic groups can be unsubstituted or substituted with one, two or three substituents independently selected from alkyl, alkoxy, amino, alkylamino, dialkylamino, arylamino, diarylamino, alkylarylamino, hydroxy, oxo, thial, halo, carboxyl, carboxylic ester, alkylcarboxylic acid, alkylcarboxylic ester, aryl, arylcarboxylic acid, arylcarboxylic ester, amidyl, ester, alkylcarbonyl, arylcarbonyl, carboxamido, alkylcarboxamido, arylcarboxamido, sulfonic acid, sulfonic ester, sulfonamido and nitro. Exemplary heterocyclic groups include pyrrolyl, 3-pyrrolinyl, 4,5,6-trihydro-2H-pyranyl, pyrid inyl, 1,4-dihydropyridinyl, pyrazolyl, triazolyl, pyrimidinyl, pyridazinyl, oxazolyl, thiazolyl, imidazolyl, indolyl, thiophenyl, furanyl, tetrhydrofuranyl, tetrazolyl, 2-pyrrolinyl, 3-pyrrolinyl, pyrrolindinyl, oxazolindinyl 1,3-dioxolanyl, 2-imidazonlinyl, imidazolindinyl, 2-pyrazolinyl, pyrazolidinyl, isoxazolyl, isothiazolyl, 1,2,3-oxadiazolyl, 1,2,3-triazolyl, 1,3,4-thiadiazolyl, 2H-pyranyl, 4H-pyranyl, piperidinyl, 1,4-dioxanyl, morpholinyl, 1,4-dithianyl, thiomorpholinyl, pyrazinyl, piperazinyl, 1,3,5-triazinyl, 1,3,5-trithianyl, benzo(b)thiophenyl, benzimidazolyl, quinolinyl, and the like.

"Heterocyclic compounds" refer to mono- and polycyclic compounds comprising at least one aryl or heterocyclic ring.

"Aryl" refers to a monocyclic, bicyclic, carbocyclic or heterocyclic ring system comprising one or two aromatic rings. Exemplary aryl groups include phenyl, pyridyl, napthyl, quinoyl, tetrahydronaphthyl, furanyl, indanyl, indenyl, indoyl, and the like. Aryl groups (including bicylic aryl groups) can be unsubstituted or substituted with one, two or three substituents independently selected from alkyl, alkoxy, amino, alkylamino, dialkylamino, arylamino, diarylamino, alkylarylamino, hydroxy, carboxyl, carboxylic ester, alkylcarboxylic acid, alkylcarboxylic ester, aryl, arylcarboxylic acid, arylcarboxylic ester, alkylcarbonyl, arylcarbonyl, amidyl, ester, carboxamido, alkylcarboxamido, carbomyl, sulfonic acid, sulfonic ester, sulfonamido and nitro. Exemplary substituted aryl groups include tetrafluorophenyl, pentafluorophenyl, sulfonamide, alkylsulfonyl, arylsulfonyl, and the like.

"Cycloalkenyl" refers to an unsaturated cyclic $C_2$-$C_{18}$ hydrocarbon which can comprise one or more carbon-carbon double bonds.

"Alkylaryl" refers to an alkyl group, as defined herein, to which is appended an aryl group, as defined herein. Exemplary alkylaryl groups include benzyl, phenylethyl, hydroxybenzyl, fluorobenzyl, fluorophenylethyl, and the like.

"Cycloalkylalkyl" refers to a cycloalkyl radical, as defined herein, attached to an alkyl radical, as defined herein.

"Heterocyclicalkyl" refers to a heterocyclic ring radical, as defined herein, attached to an alkyl radical, as defined herein.

"Arylheterocyclic ring" refers to a bi- or tricyclic ring comprised of an aryl ring, as defined herein, appended via two adjacent carbon atoms of the aryl ring to a heterocyclic ring, as defined herein. Exemplary arylheterocyclic rings include dihydroindole, 1,2,3,4-tetra-hydroquinoline, and the like.

"Alkoxy" refers to $R_{13}O$—, wherein $R_{13}$ is an alkyl group, as defined herein. Exemplary alkoxy groups include methoxy, ethoxy, t-butoxy, cyclopentyloxy, and the like.

"Aryloxy" refers to $R_{14}O$—, wherein $R_{14}$ is an aryl group, as defined herein. Exemplary arylkoxy groups include phenoxy, napthyloxy, quinolyloxy, isoquinolizinyloxy, and the like.

"Arylalkoxy or alkoxyaryl" refers to an alkoxy group, as defined herein, to which is appended an aryl group, as defined herein. Exemplary arylalkoxy groups include benzyloxy, phenylethoxy, chlorophenylethoxy, and the like.

"Alkoxyalkyl" refers to an alkoxy group, as defined herein, appended to an alkyl group, as defined herein. Exemplary alkoxyalkyl groups include methoxymethyl, methoxyethyl, isopropoxymethyl, and the like.

"Alkoxyhaloalkyl" refers to an alkoxy group, as defined herein, appended to a haloalkyl group, as defined herein. Exemplary alkoxyhaloalkyl groups include 4-methoxy-2-chlorobutyl and the like.

"Cycloalkoxy" refers to $R_{15}O$—, wherein $R_{15}$ is a cycloalkyl group or a bridged cycloalkyl group, as defined herein. Exemplary cycloalkoxy groups include cyclopropyloxy, cyclopentyloxy, cyclohexyloxy, and the like.

"Cycloalkylthio" refers to $R_{16}S$—, wherein $R_{16}$ is a cycloalkyl group or a bridged cycloalkyl group, as defined herein. Exemplary cycloalkylthio groups include cyclopropylthio, cyclopentylthio, cyclohexylthio, and the like.

"Haloalkoxy" refers to a haloalkyl group, as defined herein, to which is appended an alkoxy group, as defined herein. Exemplary haloalkyl groups include 1,1,1-trichloroethoxy, 2-bromobutoxy, and the like.

"Hydroxy" refers to —OH.

"Oxo" refers to =O.

"Hydroxyalkyl" refers to a hydroxy group, as defined herein, appended to an alkyl group, as defined herein.

"Amino" refers to —$NH_2$.

"Nitrate" refers to —O—$NO_2$.

"Nitro" refers to the group —$NO_2$

"Nitrile" and "cyano" refer to —CN.

"Halogen" or "halo" refers to iodine (I), bromine (Br), chlorine (Cl), and/or fluorine (F).

"Alkylamino" refers to $R_{17}NH$—, wherein $R_{17}$ is an alkyl group, as defined herein. Exemplary alkylamino groups include methylamino, octadecylamino, benxylylamino, cyclohexylamino, and the like.

"Arylamino" refers to $R_{18}NH$—, wherein $R_{18}$ is an aryl group, as defined herein.

"Dialkylamino" refers to $R_{19}R_2ON$—, wherein $R_{19}$ and $R_{20}$ are each independently an alkyl group, as defined herein. Exemplary dialkylamino groups include dimethylamino, dioctylamino, methyl octylamino, and the like.

"Diarylamino" refers to $R_{21}R_{22}N$—, wherein $R_2$, and $R_{22}$ are each independently an aryl group, as defined herein.

"Alkylarylamino" refers to $R_{23}R_{24}N$—, wherein $R_{23}$ is an alkyl group, as defined herein, and $R_{24}$ is an aryl group, as defined herein.

"Aminoalkyl" refers to an amino group, an alkylamino group, a dialkylamino group, an arylamino group, a diarylamino group, an alkylarylamino group or a heterocyclic ring, as defined herein, to which is appended an alkyl group, as defined herein.

"Aminoaryl" refers to an amino group, an alkylamino group, a dialkylamino group, an arylamino group, a diarylamino group, an alkylarylamino group or a heterocyclic ring, as defined herein, to which is appended an aryl group, as defined herein.

"Thio" refers to —S—.

"Sulfinyl" refers to —S(O)—.

"Methanthial" refers to —C(S)—.

"Thial" refers to =S.

"Sulfonyl" refers to —$S(O)_2$—.

"Sulfonic ester" refers to —$S(O)_2OR_{25}$, wherein $R_{25}$ is an alkyl group, an aryl group, an alkylaryl group or an aryl heterocyclic ring, as defined herein.

"Sulfonamido" refers to —$S(O)_2$—$N(R_{26})(R_{27})$, wherein $R_{26}$ and $R_{27}$ are each independently a hydrogen atom, an alkyl group, an aryl group, an alkylaryl group, or an arylheterocyclic ring, as defined herein, and $R_{26}$ and $R_{27}$ when taken together are a heterocyclic ring, a cycloalkyl group or a bridged cycloalkyl group, as defined herein.

"Alkylsulfonamido" refers to a sulfonamido group, as defined herein, appended to an alkyl group, as defined herein.

"Arylsulfonamido" refers to a sulfonamido group, as defined herein, appended to an aryl group, as defined herein.

"Alkylthio" refers to $R_{28}S$—, wherein $R_{28}$ is an alkyl group, as defined herein (preferably a lower alkyl group, as defined herein).

"Arylthio" refers to $R_{19}S$—, wherein $R_{29}$ is an aryl group, as defined herein "Alkylsulfinyl" refers to $R_{30}$—S(O)—, wherein $R_{30}$ is an alkyl group, as defined herein.

"Alkylsulfonyl" refers to $R_{31}$—$S(O)_2$—, wherein $R_{31}$ is an alkyl group, as defined herein.

"Arylsulfinyl" refers to $R_{32}$—S(O)—, wherein $R_{32}$ is an aryl group, as defined herein.

"Arylsulfonyl" refers to $R_{33}$—$S(O)_2$—, wherein $R_{33}$ is an aryl group, as defined herein.

"Amidyl" refers to $R_{34}C(O)N(R_{35})$— wherein $R_{34}$ and $R_{35}$ are each independently a hydrogen atom, an alkyl group, an aryl group, an alkylaryl group, or an arylheterocyclic ring, as defined herein.

"Ester" refers to $R_{36}C(O)O$— wherein $R_{36}$ is a hydrogen atom, an alkyl group, an aryl group, an alkylaryl group, or an arylheterocyclic ring, as defined herein.

"Carbamoyl" refers to —O—$C(O)N(R_{37})(R_{38})$, wherein $R_{37}$ and $R_{38}$ are each independently a hydrogen atom, an alkyl group, an aryl group, an alkylaryl group or an arylheterocyclic ring, as defined herein, or $R_{37}$ and $R_{38}$ taken together are a heterocyclic ring, a cycloalkyl group or a bridged cycloalkyl group, as defined herein.

"Carboxyl" refers to —$C(O)OR_{39}$, wherein $R_{39}$ is hydrogen atom, an alkyl group, an aryl group, an alkylaryl group or an arylheterocyclic ring, as defined herein.

"Carbonyl" refers to —C(O)—.

"Alkylcarbonyl" refers to $R_{40}$—C(O)—, wherein $R_{40}$ is an alkyl group, as defined herein.

"Arylcarbonyl" refers to $R_{41}$—C(O)—, wherein $R_{41}$ is an aryl group, as defined herein.

"Carboxylic ester" refers to —$C(O)OR_{42}$, wherein $R_{42}$ is an alkyl group, an aryl group, an alkylaryl group or an aryl heterocyclic ring, as defined herein.

"Alkylcarboxylic acid" and "alkylcarboxyl" refer to an alkyl group, as defined herein, appended to a carboxyl group, as defined herein.

"Alkylcarboxylic ester" refers to an alkyl group, as defined herein, appended to a carboxylic ester group, as defined herein.

"Arylcarboxylic acid" refers to an aryl group, as defined herein, appended to a carboxyl group, as defined herein.

"Arylcarboxylic ester" and "arylcarboxyl" refer to an aryl group, as defined herein, appended to a carboxylic ester group, as defined herein.

"Carboxamido" refers to —$C(O)N(R_{43})(R_{44})$, wherein $R_{43}$ and $R_{44}$ are each independently a hydrogen atom, an alkyl group, an aryl group, an alkylaryl group or an arylheterocyclic ring, as defined herein, and $R_{34}$ and $R_{35}$ when taken together are a heterocyclic ring, a cycloalkyl group or a bridged cycloalkyl group, as defined herein.

"Alkylcarboxamido" refers to an alkyl group, as defined herein, appended to a carboxamido group, as defined herein.

"Arylcarboxamido" refers to an aryl group, as defined herein, appended to a carboxamido group, as defined herein.

"Urea" refers to —$N(R_{45})$—$C(O)N(R_{46})(R_{47})$ wherein $R_{45}$, $R_{46}$, and $R_{47}$ are each independently a hydrogen atom, an alkyl group, an aryl group, an alkylaryl group, or an arylheterocyclic ring, as defined herein, or $R_{46}$ and $R_{47}$ taken together are a heterocyclic ring, a cycloalkyl group or a bridged cycloalkyl group, as defined herein.

"Phosphoryl" refers to —$P(R_{48})(R_{49})(R_{50})$, wherein $R_{48}$ is a lone pair of electrons, thial or oxo, and $R_{49}$ and $R_{50}$ are each independently a covalent bond, a hydrogen, a lower alkyl, an alkoxy, an alkylamino, a hydroxy, an oxy or an aryl, as defined herein, or $R_{49}$ and $R_{50}$ taken together are a heterocyclic ring, a cycloalkyl group or a bridged cycloalkyl group, as defined herein.

"Silyl" refers to —$Si(R_{51})(R_{52})(R_{53})$, wherein $R_{51}$, $R_{52}$, and $R_{53}$ are each independently a covalent bond, a lower alkyl, an alkoxy, an aryl or an arylalkoxy as defined herein, or $R_{51}$ and $R_{52}$ taken together are a heterocyclic ring, a cycloalkyl group or a bridged cycloalkyl group, as defined herein.

Figure 2:
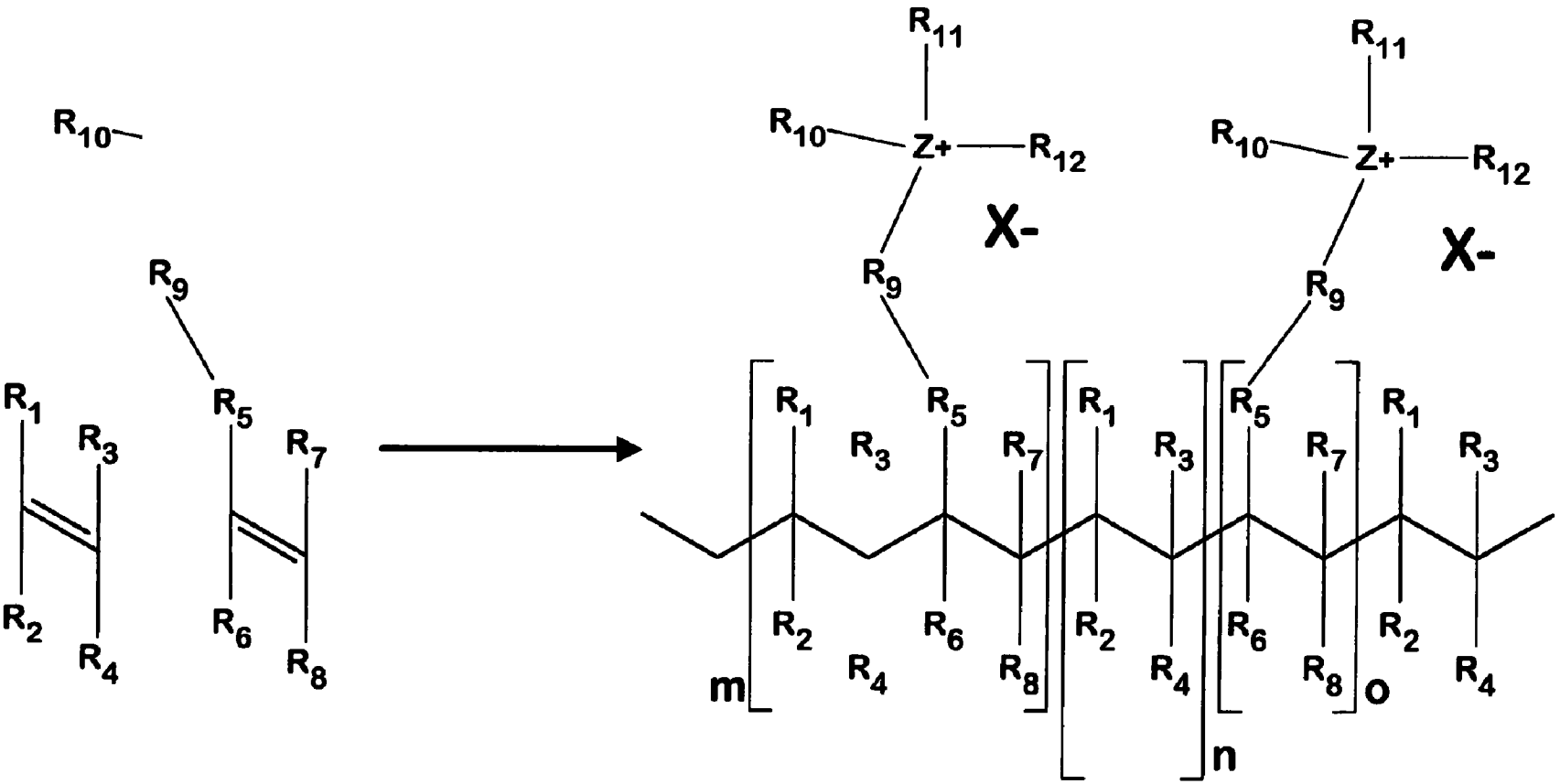
FIG. 2 shows one example to make the polymer structure of the present invention, wherein a charged species may be directly linked to a polymerizable unit.
Figure 3:
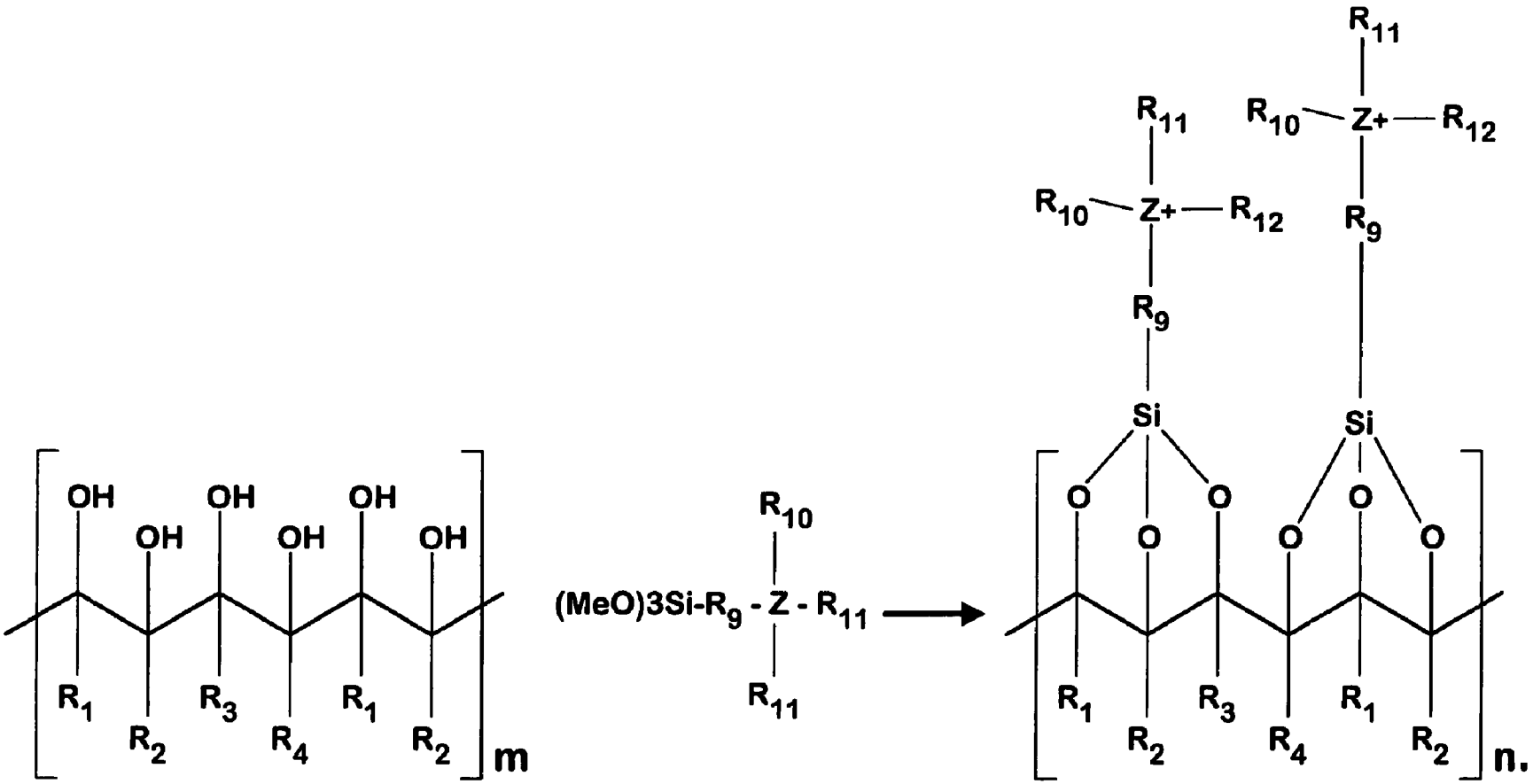
FIG. 3 shows another example to make the polymer structure of the present invention, wherein an existing polymer surface may contain reactive groups to form covalent bonds to an antibacterial agent.
Figure 4:
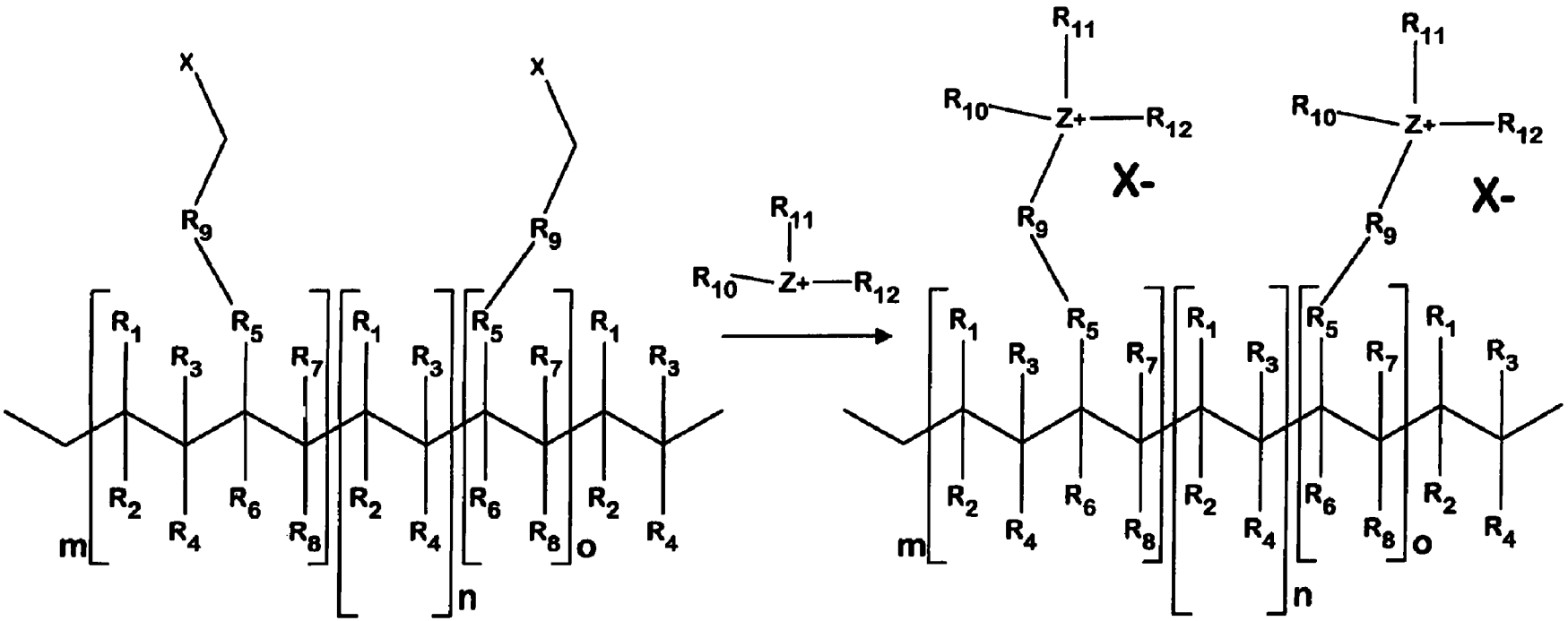
FIG. 4 shows another example to make polymer structure of the present invention, wherein the polymer contains an alkylating group which may react with a neutral species of an anti-microbial agent.

Polymeric materials containing antimicrobial side chains covalently bound to the surface can be prepared by any of several methods known in the art. For example as shown in FIG. 2, and not as a limitation to the present invention, the charged species may be linked directly to a polymerizeable unit. The unit would then be used as a component in a polymerization reaction. For example, methacryloyloxydodecylpyridium bromide could be copolymerized with methacrylate to form a polyacrylate polymer containing a quaternary ammonium salt. (See S. Imazato, et al., Incorporation Of Anti-microbial Monomer MDPB Into Dentin Primer, J Dent Res, 76 (3): 768-772 March 1997). As another example to prepare the polymer of the present invention, and not as limitation, FIG. 3 shows that an existing polymer surface may contain reactive groups which will form covalent bounds to substituents in a molecule containing an ammonium or phosphonium salt. For example, 3-(trimethoxysilyl)-propyloctadecyldimethylammonium may react with hydroxyl groups on the surface of a polymer, exchanging methoxy groups for surface bound hydroxyl groups and thus become covalently bound to the surface of the polymer. These substrates demonstrate non-leaching board spectrum antimicrobial activity. As yet another example to prepare the polymer of the present invention, and not as limitation, FIG.

4 shows a polymer which contains an alkylating group that may react with a neutral tertiary amine or phosphine. For example, 6,7-dichloropoly(glycidylmethacrylate) reacts with triethylamine to give 6,7-bis-trimethylammoniumpoly(glycidylmethacrylate) chloride. (Kenawy et al., Biologically Active Polymers: Synthesis And Anti-microbial Activity Of Modified Glycidyl Methacrylate Polymers Having A Quaternary Ammonium And Phosphonium Groups, Journal Controlled Release, 50; 145-152 1998, incorporated herein by reference). The anion of the quaternary salts may be the anion of any physiologically acceptable acid. Such a designation is one of desirability rather than of criticality since the "anion leakage" of these compounds is minimal. (See U.S. Pat. No. 4,427,796, incorporated herein by reference). While the quaternary salt will impart the anti-microbial properties the other desirable characteristics of the polymeric film will be achieved by the choice of a copolymer and/or use of laminates.

Figure 5:
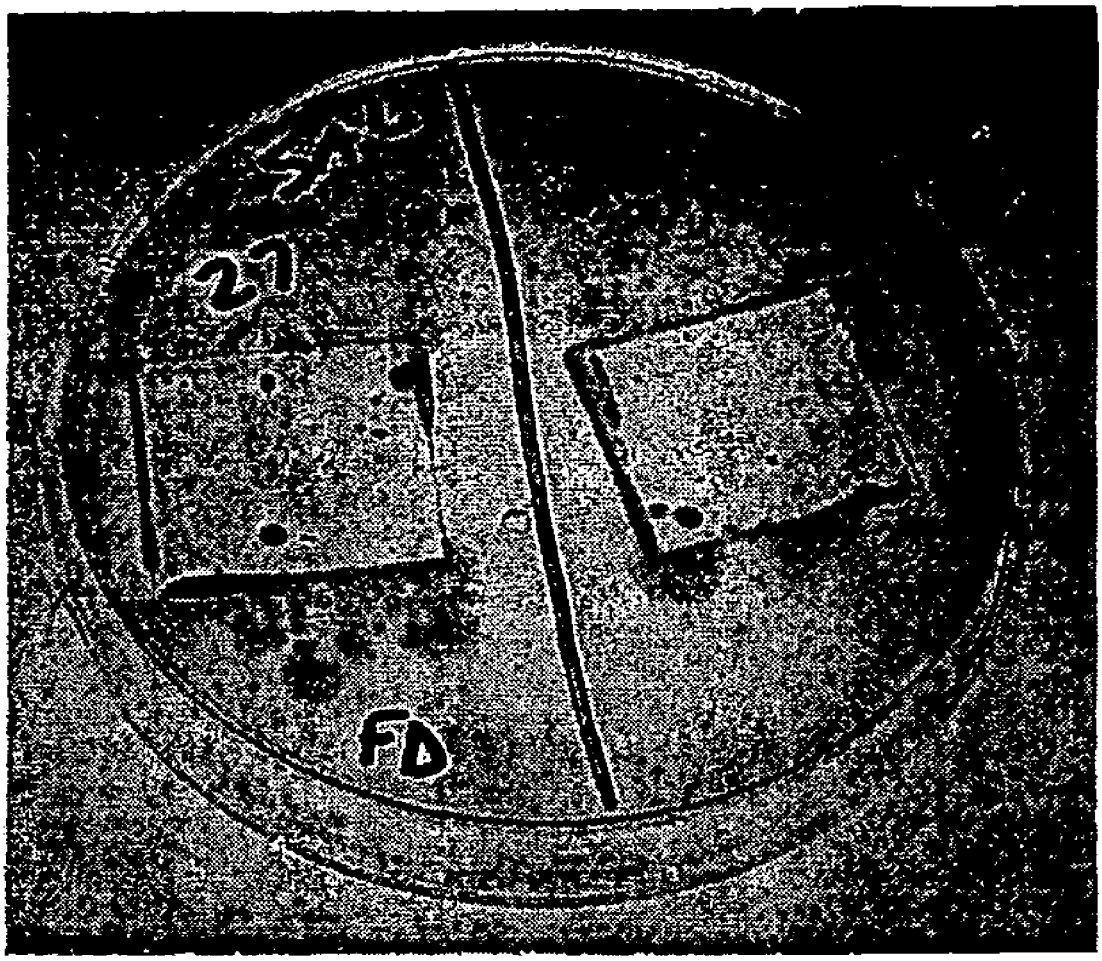
FIG. 5 is a photograph of a plate assay showing a comparison of antimicrobial activity of the antimicrobial films of the present invention.

FIG. 5 is a photograph of a plate assay showing a comparison of antimicrobial activity of the antimicrobial films of the present invention. FIG. 5 demonstrates leaching of the soluble component of a hybrid polymer into agar. Previous studies have demonstrated that C8 polymer (Dimethyloctyl [4-vinylphenyl]methylammonium chloride) is water-soluble and will dissolve into agar. Active hybrid polymer (50:50 Poly (Dimethyloctyl[4-vinylphenyl]methylammonium chloride): Poly (Dimethyldodecyl[4-vinylphenyl]methylammonium chloride) coated onto a plastic support) was placed (active surface face down) on agar, which had been pre-streaked with (Gram-negative bacteria) *Salmonella enteritidis* ATCC 49222 (approx. 1,000,000 colony forming units per milliliter [cfu/ml]). The hybrid polymer also demonstrated leaching effects.

Figure 6A:
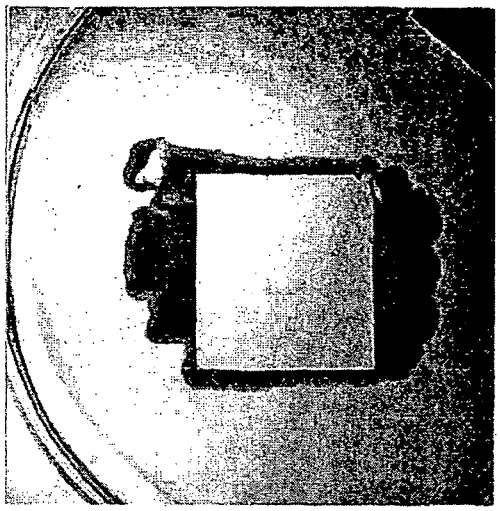
FIGS. 6A, 6B, and 6C are photographs of a plate assay showing a comparison of antimicrobial activity of the antimicrobial films of the present invention.
Figure 6B:
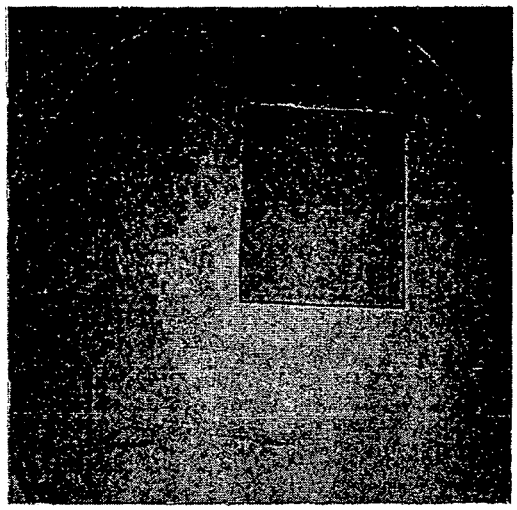
Figure 6C:
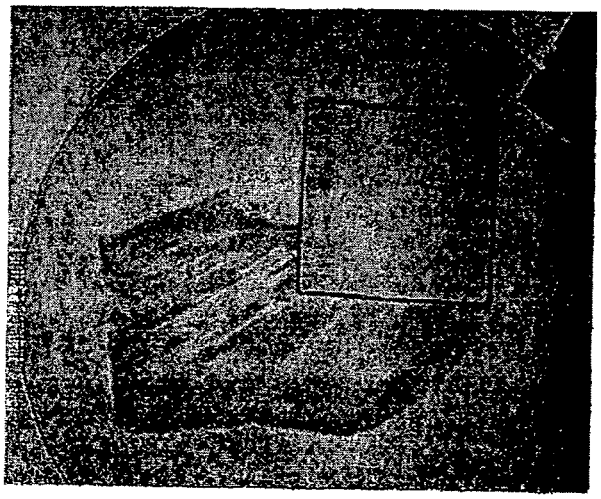

Referring now to FIGS. 6A, 6B, and 6C photographs of a plate assay showing a comparison of antimicrobial activity of the antimicrobial films of the present invention are shown. These photographs illustrate the bacteriostatic properties of specific polymers being demonstrated. An active polymer coated film was placed on top of agar pre-streaked with (Gram-positive bacteria) *Staphylococcus aureus* ATCC 29213 (approx. 1,000,000 cfu/ml). FIG. 6A shows that after 48 hours incubation at 37° C., bacterial growth was monitored. Bacteria were found to grow normally in regions not in contact with the film. However, no growth was observed in regions where the film came in contact with the agar.

FIG. 6B shows whether the film activity was bactericidal versus bacteriostatic. The film was removed and smeared onto a fresh agar plate. FIG. 6C shows that after 24 hours incubation at 37° C., new bacterial growth was observed. Based on the growth observed, the active polymer was determined to be bacteriostatic.

Figure 7:
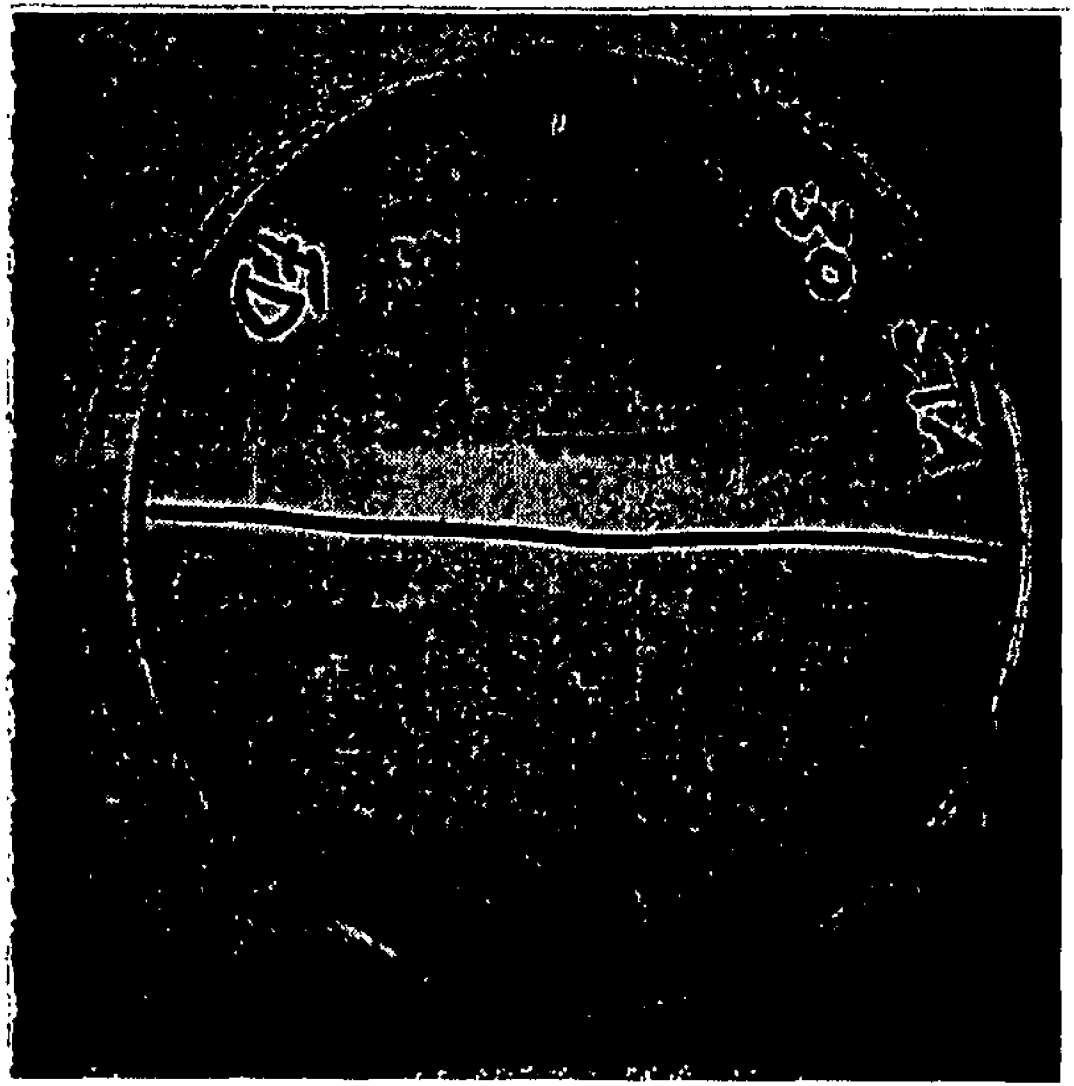
FIG. 7 is a photograph of a plate assay showing a comparison of antimicrobial activity of the antimicrobial films of the present invention.

FIG. 7 is a photograph of the results obtained with the preferred embodiment of this invention. Active 100% C14 polymer film (Poly (Dimethyltetradecyl[4-vinylphenyl]methylammonium chloride) was placed onto the streaked surface (active surface face down) and the plate incubated for 48 hours at 37° C. Using a 100% C14 polymer film, no apparent bacterial growth was observed below the film indicating that growth was inhibited. Growth right up to the edge of the support assures that no leaching has occurred. In this study, C14 (Poly (Dimethyltetradecyl[4-vinylphenyl]methylammonium chloride) was effective against *Staphylococcus* and did not exhibit leaching. No thickening occurred at the support's edges.

Figure 8A:
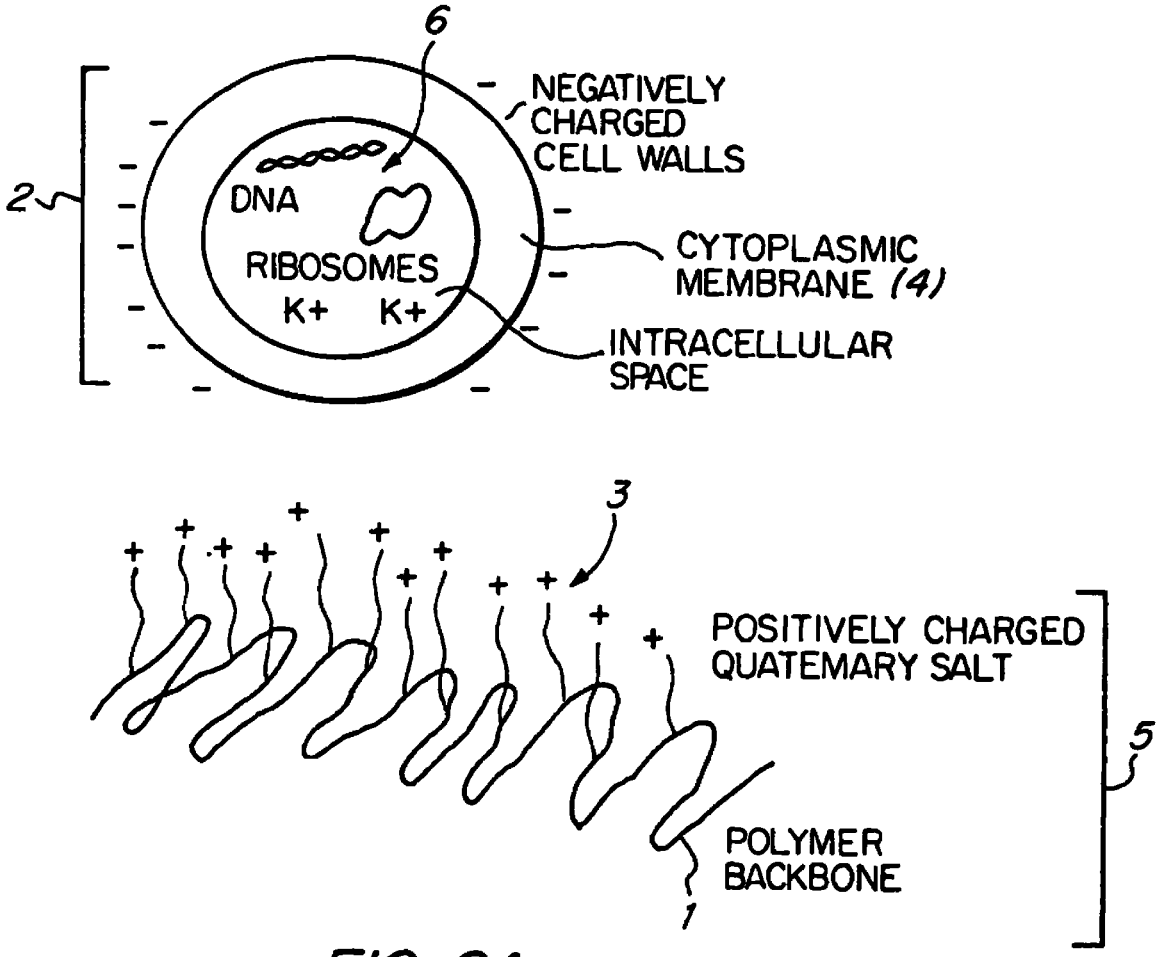
FIG. 8A is a schematic graphic illustration of the antimicrobial film of the present invention prior to contact of the film with microorganisms.
Figure 8B:
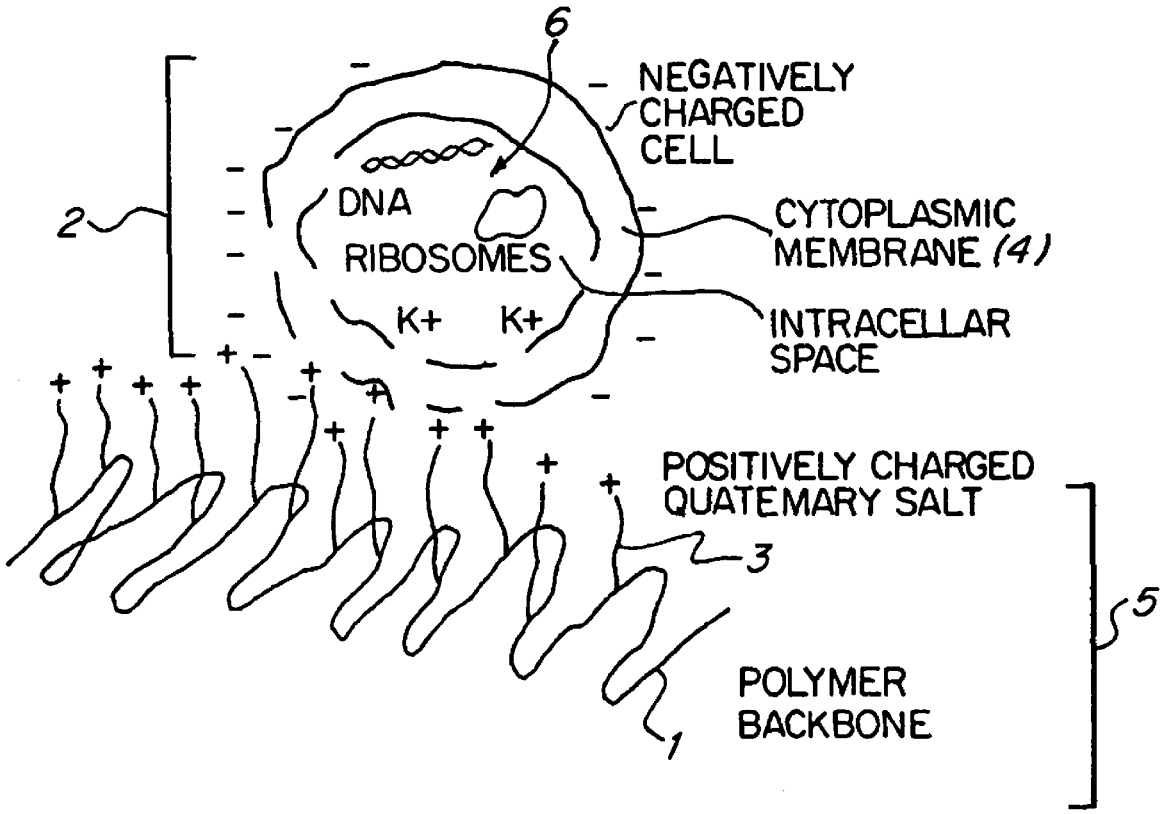
FIG. 8B is a schematic graphic illustration of the antimicrobial film of the present invention during contact of the film with the microorganism.
Figure 8C:
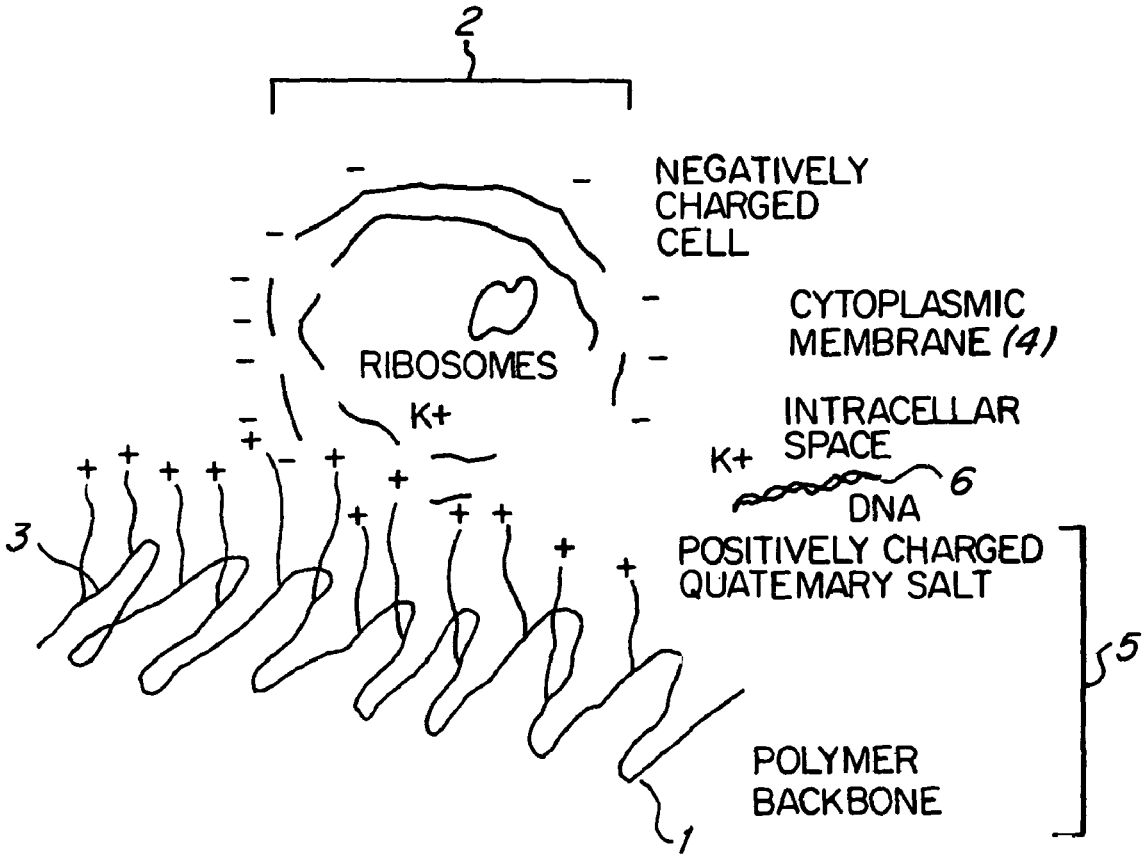
FIG. 8C is a schematic graphic illustration of the antimicrobial film of the present invention showing the death of a microbe.

In a preferred embodiment, the polymer material, forms an insoluble, non-leachable preferably straight chain polymer having a unique configuration: some of the organic material protrudes into the surrounding environment, that is, "arms", "tentacles", or "side-chains" of the organic material project away from the matrix and into the surrounding environment. This phenomenon can be understood by referring to FIGS. 8A, 8B, and 8C, which are schematic graphic illustrations of a preferred coating of the present invention in which the organic material is a polymer and the biocidal material is a selected from the group consisting of quaternary ammonium salts, pyridinum salts, and phosphonium salts, preferably quaternary ammonium salts. FIGS. 8A, 8B, and 8C show polymer matrix (1) having side-chains (3) projecting into the ambient environment. Without wishing to be bound by theory, it is believed that when a microorganism contacts the coating, the polymer side-chains dissolve into the lipid bilayer or cell wall (4) surrounding the microorganism (2), thereby causing the cell to lyse, hence killing it. More specifically FIG. 8A shows cell (2) and polymer film (5) in close proximity, prior to contact. Cell wall (4) of cell (2) is negatively charged and is electrostatically attracted to the positively charged antimicrobial side chain (3) covalently bond to a polymer backbone (1). FIG. 8B shows a schematic graphic illustration of antimicrobial film (5) of the present invention where antimicrobial side chain (3) is covalently bound to a polymer backbone (1). Antimicrobial film (5) and is able to penetrate cell (2). After prolonged contact, cell (2) will lyse to the extent that it may lose its intracellular material (6) resulting in the death of a microbe.

The following examples are given for the purpose of illustrating the present invention and are not intended to limit the scope in any way.

EXAMPLE 1a

Poly (1-(chloromethyl)-$_4$-vinylbenzene

A flame dried 1-L round bottom flask was charged with AIBN (1.9 g, 11.6 mmol) and 50 mL of anhydrous toluene. To this stirred solution was added chloromethylstyrene (76.25 g, 500 mmol) in toluene (430 mL). Argon was bubbled through the mixture; it was then warmed to 78-80° C. with stirring for 22 hrs under a blanket of argon. Approximately 50 mL of hexane was added to the flask and the whole mixture was then poured into 750 ml of hexane. A taffy-like precipitate formed. The precipitate was collected and washed a couple of times with water. The precipitate was then dissolved in THF. The THF solution was filtered. Adding petroleum ether precipitated the product that was then separated from the mother liquor. The solid was dissolved again in THF, and finally precipitated in methanol. The product was collected and dried overnight at 50° C. in a vacuum oven. This gave the title compound as a brittle, white powder (36.16 g). GPC analysis that gave the following results:

| Run 1: | Run 2: |
|---|---|
| Mw = 13750 | Mw = 13745 |
| Mn = 9882 | Mn = 9866 |
| Mp = 10708 | Mp = 10739 |
| Polydispersity = 1.391 | Polydispersity = 1.393 |

EXAMPLE 1b

Poly (Dimethyloctyl[4-vinylphenyl]methylammonium chloride)

A solution of the Product of Example 1a. (3.04 g, 20 mmol) in 1:1 IPA: THF (100 mL) was heated to reflux with stirring under argon. N, N-Dimethyloctylamine (3.14 g, 20 mmol) was added and the reaction mixture was refluxed under argon for 24 h. The reaction mixture cooled to room temperature. The volatiles were removed using a rotary evaporator to give a viscous oil. The oil was placed in a 30-35° C. vacuum oven overnight. This gave the title compound as a brittle, white powder (6.1 g). Films could be cast from 5% w/v solutions from the following solvents: IPA, methanol, and 1:1 THF:IPA onto a polyester backing.

EXAMPLE 2

Poly (Dimethyldodecyl[4-vinylphenyl]methylammonium chloride)

A solution of the Product of Example 1a (3.04 g, 20 mmol) in 1:1 IPA: THF (100 mL) was heated to reflux and stirred under argon. N, N-Dimethyldodecylamine (4.27 g, 20 mmol) was added and the reaction mixture was refluxed under argon for 24 h. The reaction mixture cooled to room temperature. The volatiles were removed using a rotary evaporator to give a viscous oil. The oil was placed in a 30-35° C. vacuum oven overnight. This gave the title compound as a brittle white powder (6.39 g). Films could be cast from 5% w/v solutions from the following solvents: IPA, methanol, and 1:1 THF:IPA onto a polyester backing.

EXAMPLE 3

Poly (Dimethyltetradecyll[4-vinylphenyl]methylammonium chloride)

A solution of the Product of Example 1a (3.04 g, 20 mmol) in 1:1 IPA: THF (100 mL) was heated to reflux with stirring under argon. N, N-Dimethyltetradecamine (4.83 g, 20 mmol) was added and the reaction mixture was refluxed under argon for 24 h. The reaction mixture cooled to room temperature. The volatiles were removed using a rotary evaporator to give a viscous oil. The oil was placed in a 30-35° C. vacuum oven overnight. This gave the title compound as a brittle, white powder (7.36 g). Films could be cast from 5% w/v solution in IPA onto a polyester backing.

EXAMPLE 4

50:50 Poly (1-Chloromethyl)-4-vinylbenzene): Poly (Dimethyldodecyl[4-vinylphenyl]methylammonium chloride)

4a. A solution of the Product of Example 1a (3.04 g, 20 mmol) in 1:1 isopropanol: THF (100 mL) was heated to reflux with stirring under argon. N,N-Dimethyldodecylamine (2.134 g, 10 mmol) was added and the reaction mixture was refluxed under argon for 24 h. The reaction mixture cooled to room temperature. The volatiles were removed using a rotary evaporator to give a viscous oil. The oil was placed in a 30-35° C. vacuum oven overnight. This gave the title compound as a brittle, white powder (4.68 g). Films could be cast from 5% w/v solution in IPA onto a polyester backing.

EXAMPLE 5

50:50 Poly (1-Chloromethyl)-4-vinylbenzene): Poly (Dimethyloctyll[4-vinylphenyl]methylammonium chloride)

5a. A solution of the Product of Example 1a (3.04 g, 20 mmol) in 1:1 isopropanol:THF (100 mL) was heated to reflux with stirring under argon. N,N-Dimethyloctylamine (1.57 g, 10 mmol) was added and the reaction mixture was refluxed under argon for 24 h. The reaction mixture cooled to room temperature. The volatiles were removed using a rotary evaporator to give a viscous oil. The oil was placed in a 30-35° C. vacuum oven overnight. This gave the title compound as a brittle, white powder (4.53 g). Films could be cast from 5% w/v solution in IPA onto a polyester backing.

EXAMPLE 6

50:50 Poly (Dimethyldodecyll[4-vinylphenyl]methylammonium chloride): Poly (Dimethyloctyll[4-vinylphenyl]methylammonium chloride)

6a. A solution of the Product of Example 1a (3.04 g, 20 mmol) in 1:1 isopropanol:THF (100 mL) was heated to reflux with stirring under argon. N,N-Dimethyloctylamine (1.57 g, 10 mmol) and N,N-Dimethyldodecylamine (2.13 g, 10 mmol) were added and the reaction mixture was refluxed under argon for 24 h. The reaction mixture cooled to room temperature. The volatiles were removed using a rotary evaporator to give a viscous oil. The oil was placed in a 30-35° C. vacuum oven overnight. This gave the title compound as a brittle, white powder (6.60 g). Films could be cast from 5% w/v solution in IPA onto polyester backing.

EXAMPLE 7

Poly (Tributyl-[4-vinylphenyl]methylphosphonium chloride)

A solution of the product of Example 1a (3.04 g, 20 mmole) in 100 mL of one-to-one mixture of isopropanol and THF was heated to reflux and stirred under Argon. Tributylphospine (3.85 g, 19 mmole) was added and the reaction mixture was refluxed under Argon for 24 h. Cooled reaction mixture and reduced it to a viscous oil by rotary evaporator. The oil was placed in an 80° C. vacuum oven overnight. Product was a white brittle powder (6.22 g, 90% yield). Films could be cast from 5% w/v solution in IPA or water onto polyester backing.

EXAMPLE 8

Poly (Trioctyl-[4-vinylphenyl]methylphosphonium chloride)

A solution of the product of Example 1a (3.04 g, 20 mmole) in 100 mL of one-to-one mixture of isopropanol and THF was heated to reflux and stirred under Argon. Trioctylphosphine (7.04, 19 mmole) was added and the reaction mixture was refluxed under Argon for 24 h. Cooled reaction mixture and reduced it to a viscous oil by rotary evaporator. The oil was placed in an 80° C. vacuum oven overnight. Product was a white brittle powder (9.75 g, 97% Yield). Films could be cast from 5% w/v solution in IPA onto polyester backing.

Biological Results

Films were cast by painting a solution of polymer dissolved in a suitable solvent onto a polyester backing material and allowing the solvent to evaporate. This generally resulted in a clear film. The supported polymeric quaternary ammonium salt film could then be cut into square pieces (1"×1") for antimicrobial activity.

| Compound | Test Protocol | Results |
|---|---|---|
| Example 1b | A1 | SG |
| Example 1b | B1 | SG |
| Example 1b | C1 | SG 2-log kill |
| Example 2 | A1 | SG |
| Example 2 | B1 | SG |
| Example 2 | C1 | SG 1-log kill |
| Example 3 | A2 | NG 2 log kill |
| Example 3 | B2 | RG |
| Example 3 | C2 | SG 2-log kill |
| Example 8 | A1 | NG |
| Example 8 | B1 | NG |
| Example 8 | C1 | NG 2 log kill |

Experimental Approaches

Experimental approaches include: A1—Confluent growth of log phase *staphylococcus* bacteria (1,000,000 cfu) were streaked onto a nutrient agar petri plate. Film was then overlaid onto the streaked area, active side down, and the plates were incubated for 24 hours at 37° C.; A2—Confluent growth of log phase bacteria (80,000 cfu), 48 hour incubation at 37° C.; B1-Films were placed on agar plates with the active side facing up and confluent growth of log phase *staphylococcus* bacteria (1,000,000 cfu) containing broth was placed directly onto the film, active side up, and agar. These plates were incubated for 24 hours at 37° C.; B2—Confluent growth of log phase bacteria (80,000 cfu), 48 hour incubation at 37° C.; C1—Log phase (1,000,000 cfu) bacteria was inoculated into nutrient broth tubes. Films were placed directly into liquid media containing *staphylococcus* bacteria for 24 hours. A 100 μl aliquot of broth was removed from each tube, plated and examined for growth; C2—Confluent growth of log phase bacteria (80,000 cfu).

General Experimental and Abbreviations: IPA, isopropanol; THF, tetrahydrofuran; AIBN, azo-bisisobutyronitrile; cfu, colony forming units; G, maximum growth observed; SG, slowed growth observed; log-kill, biociadal; NG, no growth; RG, reduced growth.

Biological Results For Poly (Trioctyl-[4-vinylphenyl]methylphosphonium chloride Polymers Qualitative assessment of surface contact antimicrobial activity of a cast polymer film of Tri-octyl (1×1 sq. inch on plastic support was performed. The plastic support could potentially compromise oxygen access for the microbes (See Method 1B below). Plastic supports with polymer cast onto its surface were placed (active surface face down) onto petri plates containing rapidly growing *Candida, Aspergillus, Pseudomonas, Staphylococcus* or *Lactobacillus*. After 24-72 hours incubation, the plates were assessed for growth and inhibition. Virgin plastic support (without a polymer coating) was tested, in parallel, as a control.

Test organisms (log phase)—media used:

(Yeast) *Candida albicans* ATCC 10231—YM agar and YM broth (Gram-positive—facultative anaerobe) *Lactobacillus fructivorans* ATCC 15435—*Lactobacillus* Sake agar and broth (Mold) *Aspergillus niger* ATCC 16404—Sabourauds Dextrose Agar (Gram-negative) *Pseudomonas fluorescens* ATCC 55129—Nutrient agar and broth Confluent growth of log phase (1,000,000 cfu) bacteria and yeast were streaked onto the appropriate media on a petri plate. 10 μl of *Aspergillus* was streaked onto the appropriate media on a petri plate. Films were then overlayered onto the streaked area. Plates were incubated for 72 hours at 30° C.

Experimental results obtained are provided in Table 1A below. After incubation, the plates were examined for reduced growth. No effect was observed on *Candida, Pseudomonas*, and *Lactobacillus. Staphylococcus* and *Aspergillus* exhibited no growth when in contact with the film.

Table 1A shows the biological results for Poly (Trioctyl-[4-vinylphenyl]methylphosphonium chloride) (Example 8) and Poly(Dimethyltetradecyll[4-vinylphenyl]methylammonium chloride) (Example 3).

TABLE 1A

| | Microbe versus Film | | | |
|---|---|---|---|---|
| | *Lactobacillus* | *Pseudomonas* | *Candida* | *Aspergillus* |
| Example 8: Film directly onto bacteria on agar plates. | G | G | G | NG |
| Example 3: Film directly onto bacteria on agar plates. | G | G | G | NG |

Method 1B: Film—petri plate testing—Broth Surface Contact Description: This was an initial qualitative assessment of surface contact antimicrobial activity of a cast polymer film on a plastic support. Plastic supports with polymer cast onto its surface were placed (active surface face up) onto petri plates and broth containing *Candida, Aspergillus, Pseudomonas, Staphylococcus*, or *Lactobacillus* was placed directly onto the active polymer surface. After 24-72 hours incubation, the plates were assessed for growth and inhibition. Virgin plastic support (without a polymer coating) was tested, in parallel, as a control.

Films were placed on agar plates with the active side facing up and microorganism containing broth placed directly onto the film and agar. These plates were incubated for 72 hours at 30° C.

Experimental results obtained are provided in Table 1B below. Reduced growth of *Aspergillus* was observed with this film type.

Table 1B shows the biological results for Poly (Trioctyl-[4-vinylphenyl]methylphosphonium chloride) (Example 8) and Poly(Dimethyltetradecyll[4-vinylphenyl]methylammonium chloride) (Example 3).

TABLE 1B

| | Microbe versus Film | | | |
|---|---|---|---|---|
| | *Lactobacillus* | *Pseudomonas* | *Candida* | *Aspergillus* |
| Microbe directly onto Film on agar plates. Example 8 | G | G | G | NG |
| Microbe directly onto Film on agar plates, Example 3 | G | G | G | NG |

Method 2A: Film—Broth testing—Bacteria and Yeast only

Description: Testing of films in broth was expected to provide both improved oxygen access, increased contact area, and direct insights into the rate and amount of antimicrobial activity present, if any.

Experimental Approach: Log phase (1,000,000 cfu) bacteria was inoculated into broth tubes. Films were placed directly into liquid media containing bacteria. After 24 hour exposure to the films, 100 μl aliquots of broth were removed from each tube, plated and examined for growth. Virgin plastic support was used, in parallel, as controls.

Experimental results obtained are provided in Tables 2A below. Reduced growth, approx. 2 log reduction of *Staphylococcus* was observed. No effect was observed for all other organisms involved in broth testing.

Table 2A shows the biological results for Poly (Trioctyl-[4-vinylphenyl]methylphosphonium chloride) (Example 8) and Poly(Dimethyltetradecyll[4-vinylphenyl]methylammonium chloride) (Example 3).

TABLE 2A

| Microbe versus Film | | | |
|---|---|---|---|
| | *Lactobacillus* | *Pseudomonas* | *Candida* |
| Microbe directly onto agar plates. Example 8 | G | G | G |
| Microbe directly onto agar plates. Example 3 | G | G | G |

Method 2B: Film—Broth testing—Bacteria and Yeast only

Description: Films that were originally incubated in broth with bacteria were directly placed onto agar for an additional 24-48 hours for the detection of microbe. Virgin plastic support and unreacted polymers was tested, in parallel, as controls.

Experimental Procedure: Film pieces were placed on agar plates with the active side facing down and these plates were incubated and examined for growth after 2448 hours.

Results: Experimental results obtained are provided in Table 2B below. There was no effect observed on any of the microbes except for *Staphylococcus*.

TABLE 2B

| Microbe versus Film | | | | |
|---|---|---|---|---|
| | *Lactobacillus* | *Pseudomonas* | *Candida* | *Staphylococcus* |
| Film directly onto agar plates. Tri-octyl | G | G | G | NG |

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A method of food preservation comprising the steps of:

providing a substrate having disposed thereon a non leaching antimicrobial coating that does not release biocidal amounts of elutables into the surrounding environment, said coating comprising an organic polymer matrix with an antimicrobial component comprising a side chain of a benzalkonium or a pyridinium salt, which is covalently bounded to backbone chains of the organic polymer matrix; and facilitating contact between the coating and a surface of a food comprising a microorganism;

wherein the antimicrobial component is in an amount sufficient to preserve food wherein the antimicrobial component is a non-metallic antimicrobial component.

2. The method of claim 1 wherein the substrate is selected from the group consisting of metal, wood, synthetic polymers, natural and synthetic fibers, cloth, paper, rubbers, and glass.

3. The method of claim 1 wherein said an organic polymer matrix is formed from a plastic selected from the group consisting of polyamide, polyethylene, polyvinylidene chloride, polyvinyl chloride, polyvinylidene, polypropylene, polyethylene terephthalate, glycol modified polyethylene terephthalate, and polycarbonate.

4. The method of claim 1 wherein said microorganisms are selected from the group consisting of bacterium, fungus, molds, yeast, and virus.

5. The method of claim 1, wherein the antimicrobial material is a contact-killing, non leaching, charged antimicrobial side chain.

6. The method of claim 5, wherein the organic polymer matrix does not release biocidal amounts of the charged antimicrobial side chain into the surrounding environment.

7. The method of claim 6, wherein the microorganism is present on food and further comprising the step of contacting the coating to at least one surface of the food to permit direct contact of the antimicrobial material in an amount sufficient to combat growth of microorganisms on the food.

8. The method of claim 7, wherein the backbone chain is selected from the group consisting of polyamide, polyethylene, polyvinylidene chloride, polyvinyl chloride, polyvinylidene, polypropylene, polyethylene terephthalate, glycol modified polyethylene terephthalate, polystyrene, polyvinylpyridine, polymethacrylate, polyacrylate, and polycarbonate.

9. The method of claim 7, wherein the backbone chain is a straight chain.

10. The method of claim 7, wherein said antimicrobial side chain is positively charged.

11. The method of claim 1, wherein the substrate is packaging that contains and contacts food.

12. The method of claim 11, wherein the coating is on at least one surface of the packaging.

13. The method of claim 11, wherein the packaging is a film having two surfaces.

14. The method of claim 13, wherein the film wraps about the food to contact at least one surface of the coating to at least one surface of the food.

15. The method of claim 11, wherein the packaging is an at least semi-rigid container that contains food.

16. The method of claim 15, wherein the packaging further comprises a lid to close the container.

17. The method of claim 1, wherein the non leaching antimicrobial coating comprises a non-metallic antimicrobial component.

18. The method of claim 1, wherein the antimicrobial component is a covalently bounded pyridinium salt.

19. The method of claim 1, wherein the antimicrobial component is a covalently bounded benzalkonium.

20. The method of claim 1, wherein the non leaching antimicrobial coating comprises an organic polymer matrix that consists of a side chain of a benzalkonium or a pyridinium salt, which is covalently bounded to backbone chains of the organic polymer matrix.

21. The method of claim 1, wherein the organic polymer matrix consists essentially of a side chain of a benzalkonium or a pyridinium salt, which is covalently bounded to backbone chains of the organic polymer matrix.

* * * * *